US008006435B2

(12) United States Patent
DeBlonk et al.

(10) Patent No.: US 8,006,435 B2
(45) Date of Patent: Aug. 30, 2011

(54) SAFETY GATE SYSTEM HAVING AN ELECTRONIC DISPLAY

(75) Inventors: Jay C. DeBlonk, Volga, SD (US); Kent Shane Miller, Brookings, SD (US); Douglas John Criddle, Warner, SD (US)

(73) Assignee: Daktronics, Inc., Brookings, SD (US)

( * ) Notice: Subject to any disclaimer, the term of this patent is extended or adjusted under 35 U.S.C. 154(b) by 1153 days.

(21) Appl. No.: 11/731,519

(22) Filed: Mar. 30, 2007

(65) Prior Publication Data

US 2008/0236045 A1 Oct. 2, 2008

(51) Int. Cl.
*E05C 7/04* (2006.01)

(52) U.S. Cl. ..... 49/366; 49/248; 16/369; 16/370; 40/606.03; 40/606.07; 256/24; 256/73

(58) Field of Classification Search ..... 49/141, 49/248, 358, 366, 367, 386; 16/366, 368–370; 40/606.03, 606.07, 606.16; 256/24, 73
See application file for complete search history.

(56) References Cited

U.S. PATENT DOCUMENTS

| | | | | |
|---|---|---|---|---|
| 1,412,769 | A * | 4/1922 | Barnes | 40/606.03 |
| 3,883,120 | A * | 5/1975 | Tippmann | 256/24 |
| 4,185,512 | A | 1/1980 | Sommer | |
| 4,271,622 | A * | 6/1981 | Tippmann et al. | 40/606.03 |
| 4,521,992 | A | 6/1985 | Campbell | |
| 5,042,198 | A * | 8/1991 | Privratsky | 49/248 |
| 5,369,841 | A | 12/1994 | Bembnowski | |
| 5,369,912 | A * | 12/1994 | Ginzel et al. | 49/141 |
| 5,557,868 | A * | 9/1996 | Tabary et al. | 40/471 |
| 5,600,921 | A * | 2/1997 | Vardaro | 49/380 |
| 5,941,002 | A * | 8/1999 | Rusin | 40/611.06 |
| RE36,428 | E * | 12/1999 | Moore et al. | 296/155 |
| 6,634,124 | B1 * | 10/2003 | Bierschbach | 40/452 |
| 6,647,592 | B2 * | 11/2003 | Presley | 16/366 |
| 6,676,113 | B2 * | 1/2004 | Christensen et al. | 256/25 |
| 6,708,956 | B1 * | 3/2004 | Mangelsen et al. | 256/24 |

(Continued)

FOREIGN PATENT DOCUMENTS

GB 2329503 A 3/1999

OTHER PUBLICATIONS

"International Application Serial No. PCT/US08/04102, International Search Report mailed Aug. 1, 2008", 1 pg.

(Continued)

*Primary Examiner* — Jerry Redman
(74) *Attorney, Agent, or Firm* — Schwegman, Lundberg & Woessner P.A.

(57) ABSTRACT

A safety gate system having an electronic display for seamless integration into a barrier with electronic display capabilities. The safety gate system includes a post and a gate hinged to the post. The gate face and post carry electronic display modules which appear when the gate is closed, as continuous with and seamlessly integrated into the display of the barrier. Preferably, the hinges are four-bar hinges, most preferably two sets of paired four-bar hinges. The safety gate also includes a lower chase or sill which allows both signal wiring and power to pass under the gate. Braced rear legs compensate for the cantilever forces of the gates when open. A latch, preferably an electromagnetic latch, auto-releases in response to a pre-set sufficient force level, such as arising crowd surge forces, being applied to the gate, as well as being remotely releasable.

23 Claims, 9 Drawing Sheets

U.S. PATENT DOCUMENTS

| | | | | |
|---|---|---|---|---|
| 6,813,853 | B1 * | 11/2004 | Tucker | 40/448 |
| 6,926,375 | B2 * | 8/2005 | Nagamine et al. | 312/111 |
| 7,018,129 | B1 * | 3/2006 | Smith | 404/6 |
| 7,055,271 | B2 * | 6/2006 | Lutz et al. | 40/605 |
| 7,187,295 | B2 * | 3/2007 | Saltzek | 340/691.1 |
| 7,240,637 | B2 * | 7/2007 | Rosen | 119/524 |
| 7,334,361 | B2 * | 2/2008 | Schrimpf et al. | 40/452 |
| 7,342,510 | B2 * | 3/2008 | Pate | 340/928 |
| 2002/0148411 | A1 | 10/2002 | Markham | |
| 2005/0086981 | A1 | 4/2005 | Talpe, Jr. | |
| 2006/0131552 | A1 * | 6/2006 | Rowley et al. | 256/59 |
| 2008/0141570 | A1 | 6/2008 | Nearman et al. | |

OTHER PUBLICATIONS

"International Application Serial No. PCT/US08/04102, Written Opinion mailed Aug. 1, 2008", 6 pgs.

* cited by examiner

SAFETY GATE SYSTEM HAVING AN ELECTRONIC DISPLAY

CROSS REFERENCES TO RELATED APPLICATIONS

None.

BACKGROUND OF THE INVENTION

1. Field of the Invention

The present invention is for controlling passage or access while providing an electronic display, and more particularly, pertains to a gate having electronic display capabilities and a variably controllable latch.

2. Description of the Prior Art

Barriers are typically employed for limiting passage or access of attendees at sports events and/or mass audience entertainment events. At musical concerts, barriers may keep attendees from physically interrupting a performance on stage. Barriers, such as those often situated about a soccer pitch periphery, serve to keep fans from interfering with athletes during an athletic match and may serve to limit fans to predetermined safe viewing locations. At the termination of an event, it may be desirable to enable passage through the barrier to facilitate fan dispersal. Additionally, in the event of a panic or stampede of a crowd of fans attending a mass event such as a soccer match, it may be desirable to allow incursions onto an athletic field or soccer pitch by enabling passage through the barrier so as to reduce crowd over-concentrations and the injuries which oftentimes may accompany surges of crowds of excited fans.

One solution to allowing passage past a barrier has been to provide a lower receiving pit into which an entire barrier is recessed or lowered out of position, for example, by the use of hydraulics or pneumatics. Another solution to allow passage past a barrier is to include a horizontal hinge near the base of a barrier, then tip the barrier forward, thereby allowing passage by walking over the now horizontally oriented back of the barrier. In a more traditional solution, the barrier is permanently mounted and multiple traditional gates are provided. However, traditional gates typically require attendants or officials to release each gate. The first solution is undesirable because the accepting pit is expensive and a large capital investment is required. Further, significant safety concerns accompany each lowering of a barrier while a crowd is in intimate contact with the moving barrier. A hinge-to-horizontal barrier also is costly and is prone to safety concerns if tipped while in contact with a crowd. The traditional gate solution, while initially less costly, remains highly labor intensive and still undesirable from a safety stand point because each gate relies upon the cool-headedness of each live attendant performing a task in a potentially life threatening crowd incursion situation.

From a communications perspective, there has been a modern trend to provide displays of graphics, information, and even animation for entertaining and communicating with fans at sporting events and/or mass audience entertainment. Such displays may convey messages of team support, game data, song lyrics and/or advertising on the barriers. Such displays also increase the attention and entertainment aspect of telecasts or films of the event. One especially versatile display is an electronic display. Modern electronic displays often employ a modular arrangement and may vary the electronic display depending upon context. As such, they also possess the ability to convey safety instructional messages in context to fans when appropriate. It would be desirable to modify a barrier to include one or more gates, each with advanced safety and control features, while still providing an uninterrupted or uniform arrangement of electronic display continuing through closed gates of the barrier. Such a system would include controlled latching of each gate, incorporating both remote release or opening of each gate when appropriate, along with automatic context-sensitive release or opening of the gate, particularly during emergencies, such as crowd surges.

SUMMARY OF THE INVENTION

The general purpose of the present invention is to provide a safety gate system with an electronic display.

According to one embodiment of the present invention, there is provided a safety gate system can be integrated into a barrier system with electronic display capabilities so as to allow controlled passage through the barrier system either automatically or by remote release of latched gates. The safety gate system includes a post, preferably two posts spaced apart from each other; a gate hinged to the post and movable between a closed position or condition disallowing passage through the barrier system, and an open position or condition allowing passage through the barrier system. Preferably, the gate is one of two paired gates. Each gate of the pair is hinged and/or carried by one of the preferred two posts. A latch system holds the gate or gates in the closed position or condition; and the gate or gates has/have a face substantially providing an electronic display which appears substantially seamlessly integrated into the electronic display capabilities of the barrier system. Preferably, the electronic display capabilities of both the barrier system and the electronic display of the face of the gate employ electronic display modules mounted in a matrix or grid or array arrangement. That is, an array of rows and columns of electronic display modules, which together convey an impression of seamless integration into a single large display format. Preferably, the gates hold or carry a three horizontal row by four column array, the posts hold or carry a three horizontal row by two column array, such that a two post/two gate system carries or holds three horizontal rows by twelve vertical columns. Preferably, the latch of the safety gate system auto-releases when subjected to sufficient opening force, such as the force from a surging crowd, more preferably a force from about 1 kg to about 30 kg, and most preferably a force of about 20 kg. The latch may also be remotely released. The auto-yielding release and remote release of the gate or gates allow crowds of fans to disperse in a safe manner, for example, by providing necessary egress points from a stadium onto a pitch at a crowded soccer match. The gate or gates preferably have a biasing means, more preferably a pneumatic strut or struts to urge the gate or gates from closed toward open. Preferably, the hinges are four-bar hinges, more preferably there are four four-bar hinges, the four four-bar hinges being parallel and vertically spaced apart from each other, with two upper four-bar hinges paired together by a hinge coordinator plate and two lower four-bar hinges paired together by another hinge coordinator plate. This type of hinge accommodates the thickness of display carried by the gate to be rotated out and away from the stationary frame with minimal rubbing and binding of moving parts. Additionally, the four-bar hinge arrangement allows for the gates to eccentrically move about pivot points of a short bar and a long bar of the four-bar hinge. This four-bar hinge linkage arrangement resulting in conveying the impression that the gates first move forwardly, toward the pitch, then swing perpendicular to the barrier. Electrical wiring cable conduit is flexible and passes near the hinges to carry power and signaling to the display modules on the gates. The four-bar hinges allow the gate to initially move toward the front then transition to generally pivotably move toward perpendicular to its initial closed position. The system, in closed position and the electronic display modules mounted therein, appears to seamlessly integrate into the repetitive matrix pattern of the barrier display. In one embodiment, the safety gate system of the present invention may be used as an entrance to and exit from athletic playing fields, for example, in soccer matches. In such an embodiment, the safety gate system may be incorporated into a soccer pitch perimeter display to allow uninterrupted video display around a soccer match. In another embodiment, this gate system may also be used to control access to storage space located rearward of a barrier electronic display while providing an apparent seamlessly integrated electronic display on the front face. In such an embodiment, the auto-release force of the latch may be set lower so that stadium personnel need only give a sufficient pull force to open and reveal storage space behind the gate. In such an embodiment, the auto-release latch may be frictionally, magnetically or mechanically operated or some combination thereof.

The present invention is also a method of controlling access though a barrier with an electronic display capability. The method includes the steps of providing an electronic display capability gate including a post, a gate hinged to the post and movable between a closed condition and an open condition, a lower electronic wire chase compartment underlying the gate in the closed condition and a latch; providing a gap in the barrier corresponding to the electronic gate width; installing the electronic gate and post in the gap; and latching the gate in the closed condition. Preferably, the gate is one of two gates, each carried by a separate post. The preferred two gates are preferably magnetic latched with a latch yield automatically occurring when subjected to a force, preferably a force associated with or near an arising dangerous crowd surge, for example, and most preferably a force of about 20 kg. Preferably, the gate or gates are capable of providing a seamless display across digital electronic display modules carried on the gate front face when the gate is closed.

One significant aspect and feature of this invention is the ability to have part or all of an electronic display capable of swinging open.

Another significant aspect and feature of this invention is the gas shock/pneumatic device mounted on the swinging gate and post to aid in opening and keeping open the swinging gate portion of the display.

Still another significant aspect and feature is the adjustable force setting required to open the gate in an emergency.

Yet another significant aspect and feature of this invention is the safety provided to fans in an enclosed setting by providing necessary egress points from the stadium onto the pitch.

One more significant aspect and feature is the concealed cabling to prevent tripping hazards.

Still a further significant aspect and feature is the fully enclosed mechanism and eased or beveled edges to eliminate clothing catches or snags.

Still another significant aspect and feature is the module/alignment between barrier, gate and post.

One more significant aspect and feature is the ability of the present invention to interconnect with existing reconfigurable pitch perimeter displays, such as the ProPitch™ system of Daktronics of Brookings, S.D.

Still one more significant aspect and feature is the electromagnetic remote control used to control the latch mechanism.

Finally another significant aspect and feature of this invention is providing a low cost emergency exit system for sports fields.

Having thus described certain significant aspects and features of the present invention, one principal object of the present invention to provide a controlled opening gate or gates in an electronic display formed of electronic display modules which are seamlessly integrated into the electronic display of the barrier.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 5 further illustrates, in phantom, the viewpoint from which FIGS. 6, 7 and 8 are taken from;

FIG. 6 is a fragmentary enlarged top view of the safety gate system with electronic display, previously shown in FIG. 1, shown with top structure and shields separated and providing detail of a representative four-bar hinge in closed condition;

FIG. 7 is a fragmentary enlarged top view of the safety gate system with electronic display, previously shown in FIG. 1, shown with top structure and shields separated and providing detail of a representative four-bar hinge in an intermediate position between closed and open conditions;

FIG. 8 is a fragmentary enlarged top view of the safety gate system with electronic display, previously shown in FIG. 1, with top structure and shields separated and providing detail of a representative four-bar hinge in open condition; and, FIG. 9 is a fragmentary enlarged isometric view showing details of the right gate and four four-bar hinges thereof in open condition with some portions foreshortened to reveal details thereof.

DETAILED DESCRIPTION OF THE PREFERRED EMBODIMENTS

Figure 1:
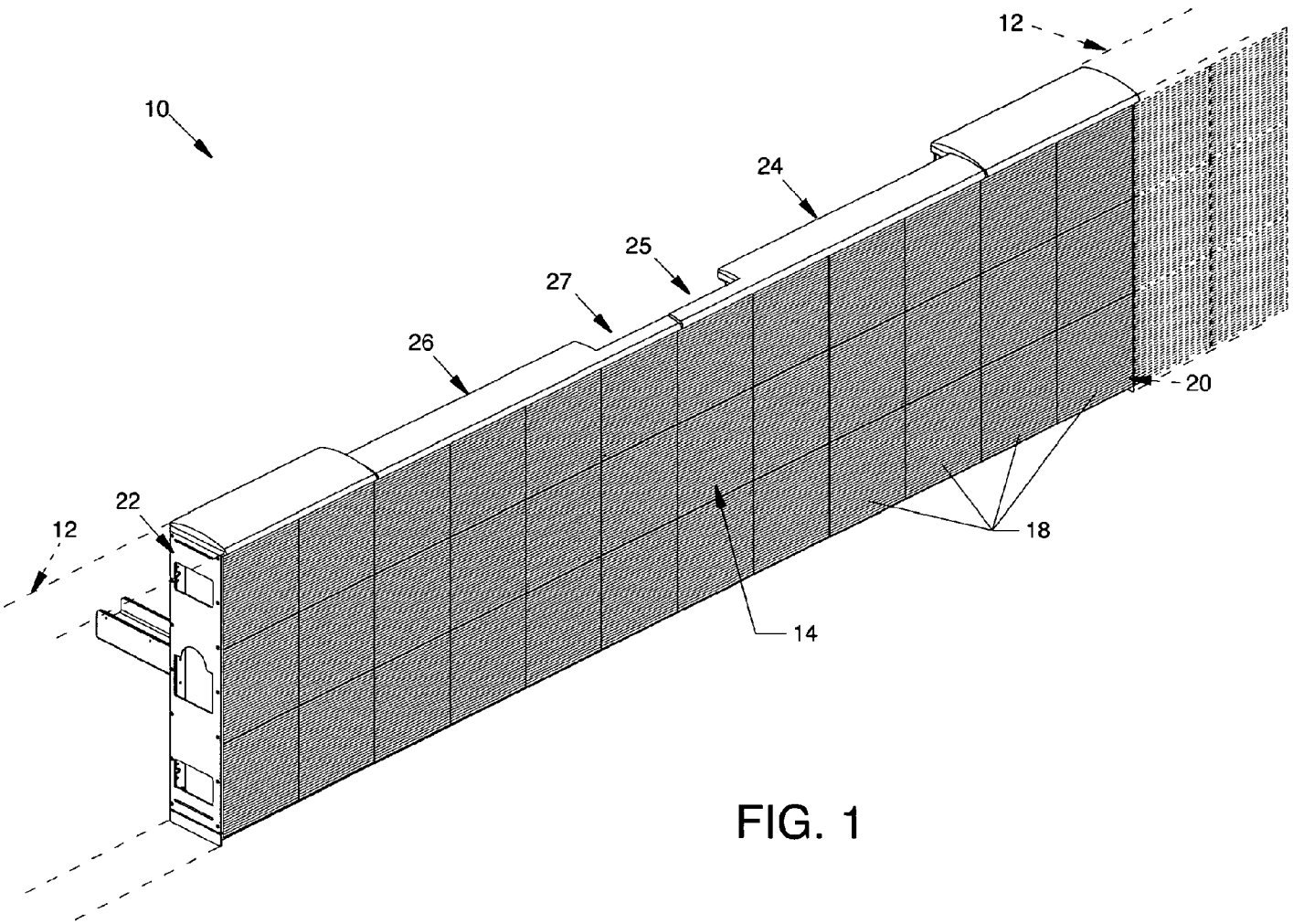
FIG. 1 is an isometric view taken from the upper left front of a safety gate system with electronic display, the present invention, shown with the gates in a closed configuration and with louver covered display modules, barrier electronic displays, in ghost, are also depicted to the right and left.

FIG. 1 is an isometric view of a safety gate system 10 of the present invention, shown aligned within and filling a gap in a barrier 12 (shown in ghost) or, alternatively, replacing a length or segment of barrier 12. As such, the safety gate system 10 may be considered a safety barrier or part of a safety barrier. It should be understood that the safety gate system 10 of the present invention also can be used in plural aligned arrangements of end-to-end safety gates 10, thereby forming a safety barrier. Preferably, safety gate systems 10 of the present invention can be situated at desirable locations along the barrier 12, such that the safety gate systems 10 may yield and thereby open at a preselected force pushing against the gates. Alternatively, the safety gate system 10 may be remotely opened. Opening of the safety gate system 10 reduces the pressure of a crowd of fans, thereby crushing injuries typically experienced by fans in dangerous crowds may be reduced or avoided. The safety gate system 10 of the present invention, in a preferred embodiment, includes a front face 14 which is directed toward a pitch, field, or stage situated opposite fans. The front face 14 is covered by electronic display modules 16 (FIG. 3), most preferably display modules of U.S. Pat. No. 7,055,271 entitled "Electronic Display Module Having a Four-Point Latching System for Incorporation into an Electronic Sign", incorporated by reference herein in its entirety. Each electronic display module 16 preferably has a louver panel 18 visible from the pitch, which louver panel 18 functions to protect players or equipment from contact with the electronic display module 16 while providing shade to LEDs of the electronic display module 16. Such louvered panels 18 have been previously described in U.S. application entitled "Thermoplastic Elastomer Protective Louver Covering For Use with an Electronic Display Module", application Ser. No. 11/589,405 filed Oct. 30, 2006, incorporated by reference herein in its entirety. Additionally, each electronic display module 16 has a latch mechanism for easy and rapid four-point attachment to the front face 14 of the safety gate system 10, and thereby may be removed and repaired or replaced simply and quickly. The electronic display modules 16 are aligned and arranged in a grid arrangement of rows and columns and are connected to power and communications circuits within the safety gate system 10. The power and communication circuits of the safety gate system 10 connect, in turn, to power and communications circuits within the barrier 12. The safety gate system 10 includes a right post 20, a left post 22, a right gate 24 carried by and movable relative to right post 20, and a left gate 26 carried by and movable relative to the left post 22. Deployed in arrays of rows and columns on front face 14 are a plurality of electronic display modules 16, including louver panels 18. Suitable and preferred electronic display modules 16 are available from Daktronics, Inc. of Brookings, S.D. These electronic display modules 16 have been previously incorporated into other electronic signs and scoreboards as arrays. Together, the array is driven by computer directed power, signaling and display software to display a large message display extending over several or many or even the entire array of electronic display modules. In a preferred embodiment, the safety gate system 10 may be interconnected mechanically and electrically with the ProPitch™ reconfigurable pitch perimeter display system which is also available from Daktronics, Inc. of Brookings, S.D. The ProPitch™ reconfigurable pitch perimeter display system is a modular advertising and entertainment display system providing a color LED display directed toward a soccer pitch from the soccer pitch perimeter. It is reconfigurable in that it is modular and uses removable alignment pins between horizontally aligned modules, along with a single wrench latch mechanism between modules, a single connector for power between modules, and a single connector for its control signal between modules. In particular, the right post 20 and the left post 22 connect or latch mechanically and electrically for power and control signal with the ProPitch™ reconfigurable pitch perimeter display system. In such a use, the array or matrix of electronic display modules gives the impression of a continuous and seamlessly integrated display characterized by a general impression that electronic display modules are not separately identifiable as gates within the pitch directed display barriers. The same seamlessly integrated effect observed in the Daktronics, Inc.'s ProPitch™ display is continued through the front face 14 of the safety gate system 10 when aligned and connected with the barrier 12 formed from ProPitch™ reconfigurable pitch perimeter display systems. That is, a fan situated across the pitch, field or stage viewing the front face 14 of the safety gate system 10, as well as viewing the pitch directed face of the barrier 12 adjacent the safety gate system 10 when the right gate 24 and the left gate 26 are closed, receives the visual impression of a continuous visual display or message incorporating the front face 14 of the safety gate system 10. Further, the resulting large message displays often are animated to better attract attention and/or provide a more eye-appealing display.

Figure 2:
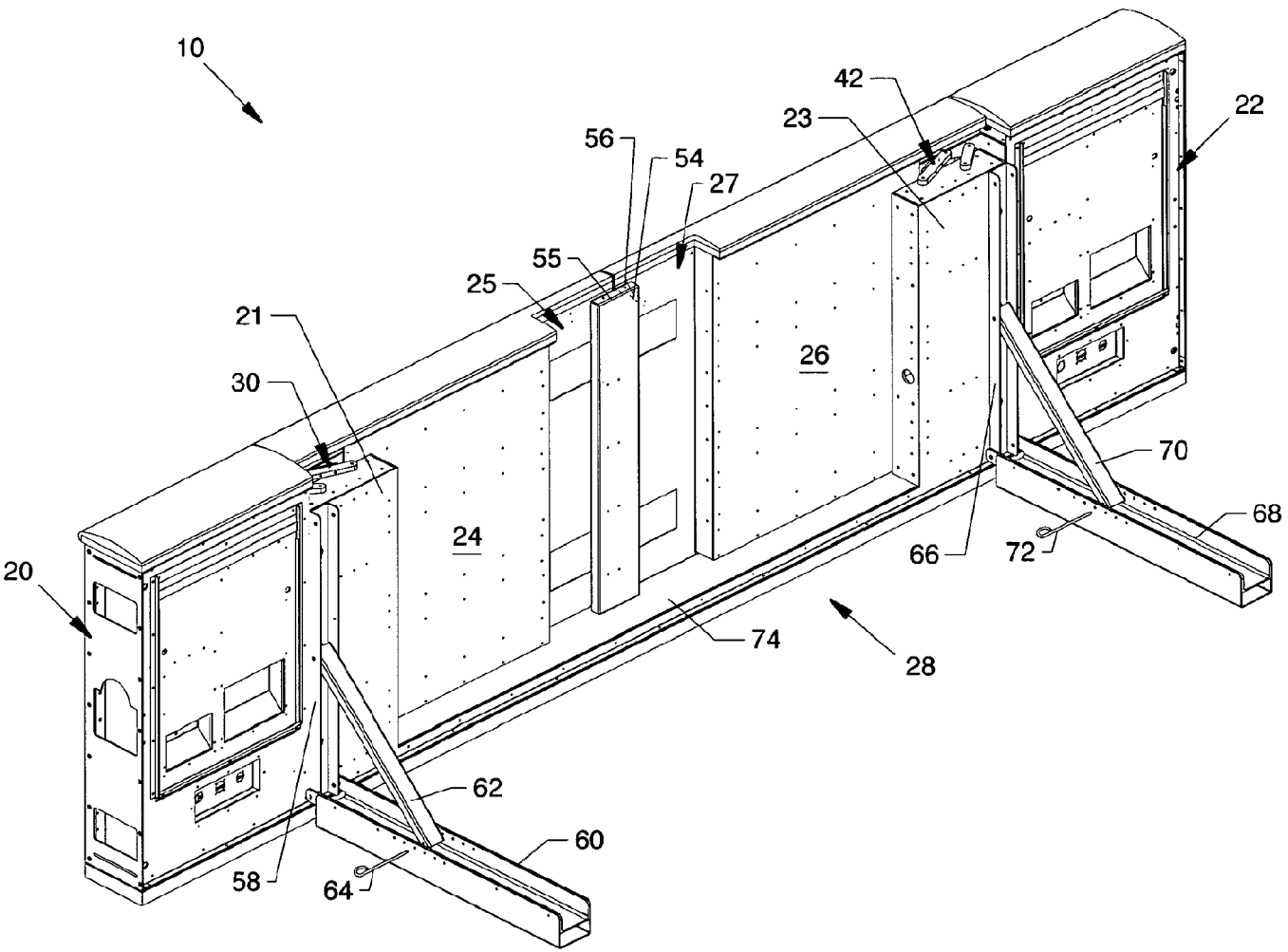
FIG. 2 is an isometric view taken from the upper right rear of the safety gate system with electronic display, previously shown in FIG. 1, shown in with the gates in a closed configuration.

As shown in FIG. 2, a rear face 28 of the safety gate system 10 is directed toward fans and away from the pitch. Affixed message placards or paint may be visible on the rear face 28. Such message placards or paint may be advertising, or more preferably, safety instructions to fans. Alternatively, the fan-directed messages of the rear face 28 may be displayed by electronic displays which can be activated to visually alert fans with a safety message, for example, that the right and left gates 24 and 26 are opening. The right gate 24 is carried, in part, on the top right four-bar hinge 30 on the right post 20, and the left gate 26 is carried, in part, by the top left four-bar hinge 42 on the left post 22. The four-bar hinges 30 and 42 are accompanied by other four-bar hinges, as will be shown subsequently. An important safety feature of the safety gate system 10 is a latch projection 54 carried by the right gate 24 opposite the top-right four-bar hinge 30. Note that the latch projection 54 has eased or beveled corners 55 to avoid or reduce snagging clothing during opening. A magnetic mating latch 56, complementary to the latch projection 54, is carried by the left gate 26 opposite top-left four-bar hinge 42. Together, the latch projection 54 and the magnetic mating latch 56 hold the right and left gates 24 and 26 in closed condition/position as fans or crowds of fans push against the right and left gates 24 and 26. When the force reaches a selected level, preferably an adjustable level, for example from about 1 kilogram to about 30 kilograms, most preferably about 20 kilograms, the latch projection 54 and the magnetic mating latch 56 separate and yield to the force of the crowd of fans. The right and left gates 24 and 26 then move toward the front face 14 or pitch. In one embodiment, a rare earth permanent magnet may be used in the latch projection 54 to provide magnetic attraction to the magnetic mating latch 56. In another embodiment, the latch projection 54 is an electromagnet, which when remotely activated is attracted to the magnetic mating latch 56. In both embodiments, the magnetic mating latch 56 may be a steel plate within or upon the left gate 26. Due to the four-bar hinges 30 and 42, the motion of the right and left gates 24 and 26 is both controlled and complex. Initially, each right gate 24 and left gate 26 moves toward the pitch or the front face 14. However, this initial opening motion begins to increasingly involve motion near the latch projection 54 and the magnetic mating latch 56. Simultaneously, at the four-bar hinges 30 and 42 (and other corresponding four-bar hinges), the initial opening motion begins to increasingly involve rotation about pivots of the four-bar hinges 30 and 42. As the opening motion continues to conclusion, the right and left gates 24 and 26 reach an open position/condition roughly perpendicular to the closed position/condition. A right reduced gate section 25 and a left reduced gate section 27 preferably is included on the right gate 24 and left gate 26, respectively, in the region of the latch projection 54 and the magnetic mating latch 56, and where the left and right gates 26 and 24 meet. These right and left reduced gate sections 25 and 27 further serve to facilitate closing or opening without binding interference. As such, the right and left reduced gate sections 25 and 27 work in cooperation with the four-bar hinges 30 and 42 to provide smooth opening and closing substantially free of interference. The safety gate system 10 may be permanently mounted or, alternatively, may be used as a temporary installation, for example, as part of a temporary barrier. In such temporary installations, it is desirable to employ a right rear vertical channel 58 mounted on the rear face of the right post 20, and similarly a left rear vertical channel 66 mounted on the rear face of the left post 22. The right and left rear vertical channels 58 and 66 are pivotably attached, respectively, to the right rear leg 60 and the left rear leg 68, and further stability is provided by pivotably attaching a right brace 62 and a left brace 70. Additionally, while the safety gate system 10 is depicted as vertically arranged, there may be situations where it is desirable for either atheistic or functional purposes to incline the safety gate system 10 either toward the front face 14 or toward the rear face 28. One typical reason is an incline already present in the adjacent barrier 12, in some cases such barrier inclinations are intended to improve the angle and view of fans or cameras present at the event. To accommodate such nonperpendicular arrangements between the right and left rear vertical channels 58 and 66 and the right and left rear legs 60 and 68, respectively, a plurality of attachment positions, preferably on the right and left rear legs 60 and 68, or alternatively, on the right and left vertical channels 58 and 66, respectively, are pivotably and adjustably connected by pins 64 and 72, respectively. Another reason for employing a nonperpendicular arrangement of the right and left rear legs 60 and 68 is to accommodate sloped, nonlevel or otherwise uneven ground supporting the safety gate system 10. When attached to the supporting ground, the right and left rear vertical channels 58 and 66, the right and left rear legs 60 and 68, the right and left braces 62 and 70, and the pins 64 and 72 serve to stabilize the safety gate system 10, particularly when the right and left gates 24 and 26 are in an open condition/position cantilevered relative to the right and left posts 20 and 22. Additionally, stability is afforded the safety gate system 10 when crowds of fans push against the right and left gates 24 and 26 prior to release of the latch projection 54 from the magnetic mating latch 56 at a preselected sufficient force, for example, a pushing force of about 20 kilograms.

Figure 3:
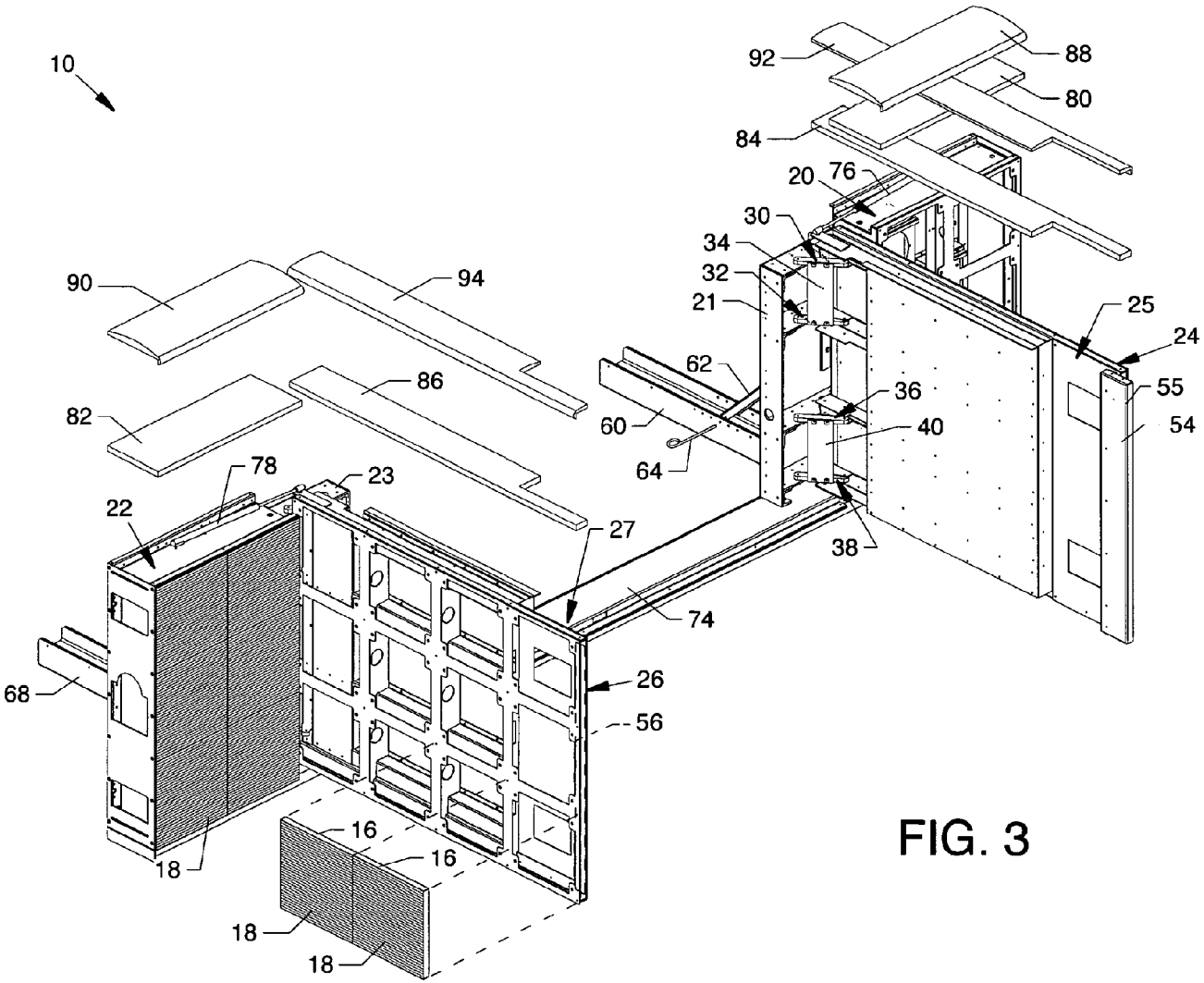
FIG. 3 is an isometric view taken from the upper left front of the safety gate system with electronic display, previously shown in FIG. 1, shown with the gates in an open configuration and with top and shield components separated and some display modules and louvered panels removed or separated for facilitation of understanding and comprehension.

As shown in FIG. 3, when the right and left gates 24 and 26 are in the open condition/position, the right and left gates 24 and 26 are in a cantilevered condition relative to the right and left posts 20 and 22 of the safety gate system 10. The right and left rear legs 60 and 68 and right and left braces 62 and 70 (shown in FIG. 2) serve to counteract the cantilevered right and left gates 24 and 26. A lower chase or sill structure 74 provides space for the right and left gates 24 and 26 to move without catching on the ground of the pitch or field during opening or releasing when the magnetic interaction of the latch projection 54 yields and separates from magnetic mating latch 56. The lower chase or sill 74 also serves to maintain consistent spacing and vertical orientation between right and left posts 20 and 22. Significantly, the lower chase or sill 74 provides an internal pathway through which wire cabling for power and signaling may be lead both from and/or for portions of barrier 12 adjacent either side of the safety gate system 10. This, in turn, leads to added safety in that fans are precluded from contact with wire cabling which could be either an electrical or tripping hazard if such were not passed through lower chase or sill 74. Broad relationships of the several four-bar hinges are now described, additional narrow detail of representative four-bar hinge 30 is available from observation and description of sequential FIGS. 6, 7 and 8. The top right four-bar hinge 30 is an upper member of four right four-bar hinges aligned in parallel and carrying the right gate 24 on the right post 20. The top right four-bar hinge 30 is paired with an upper mid right four-bar hinge 32. To reduce binding and assure smooth action of the paired four-bar hinges 30 and 32, an upper right hinge coordinator plate 34 is attached to long bars 106 of the right four-bar hinges 30 and 32, thereby maintaining a parallel and coordinated relationship between these two hinges. A lower mid right four-bar hinge 36 and a bottom right four-bar hinge 38 are similarly stabilized by a lower right hinge coordinator plate 40 attached to long bars 106 of the lower mid right four-bar hinge 36 and the bottom right four-bar hinge 38. A mirror image of the top right four-bar hinge 30, the upper mid right four-bar hinge 32, the lower mid right four-bar hinge 36, and the bottom right four-bar hinge 38, as well as the upper right hinge coordinator plate 34 and the lower right hinge coordinator plate 40, is present between the left post 22 and the left gate 26, in that the left top four-bar hinge 42 is paired with an upper mid left four-bar hinge by an upper left hinge coordinator plate 46 being attached to the long bars 106 of such hinges and a lower mid left four-bar hinge 48 paired with a bottom left four-bar hinge by a lower left hinge coordinator plate being attached to long bars 106 of such hinges. Also shown in FIG. 3 is the grid pattern of rows and columns for accepting the electronic display modules 16 and the louver panels 18 thereon. Preferably, the right and left gates 24 and 26 each have three rows and four columns and the right and left posts 20 and 22 each have three horizontal rows and two vertical columns. When closed, the safety gate system 10 shows three horizontal rows and twelve vertical columns. When display power and control are applied, the array of thirty-six preferred electronic display modules 16 appear as one integrated display. When inserted in the barrier 12 of FIG. 1 with a similar three horizontal row display, the safety gate system 10 when closed appears to be integrated into the barrier 12 and the electronic display module 16 provided on the barrier 12.

Figure 4:
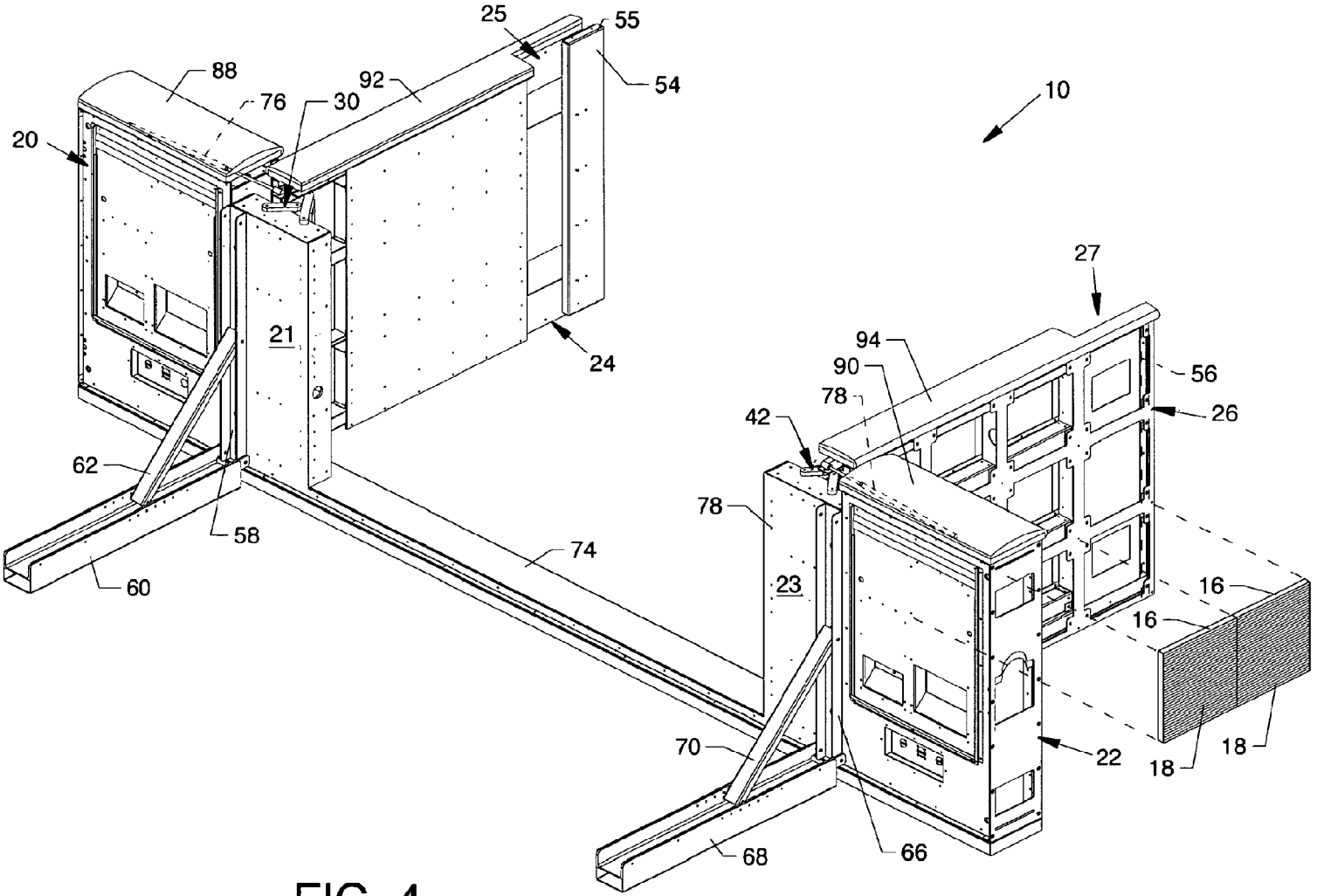
FIG. 4 is an isometric view taken from the upper left rear of the safety gate system with electronic display, previously shown in FIG. 1, shown with the gates in an open configuration and with display modules and louvered panels removed or separated for facilitation of understanding and comprehension.

As shown in FIG. 4, a right post/hinge extension 21 is attached to the right post 20 and encloses and carries the top right four-bar hinge 30. The upper mid right four-bar hinge 32, the lower mid right four-bar hinge 36, and the bottom right four-bar hinge 38 are also attached to the right post/hinge extension 21 as shown in FIG. 3. A left post/hinge extension 23 attached to the left post 22 encloses and carries the top left four-bar hinge 42, as well as other attached hinges including an upper mid left four-bar hinge, a lower mid left four-bar hinge, a bottom left four-bar hinge corresponding to other previously just described like and similar components. The rear face of the right and left post/hinge extensions 21 and 23 serve to also shield sport spectators from exposure to the multiple four-bar hinges enclosed and carried therein. Additionally, the right and left post/hinge extensions 21 and 23 are located rearwardly to provide clearance for opening the right and left gates 24 and 26 as the right and left gates 24 and 26 have a generally thinner or narrower front-to-rear section than the right and left posts 20 and 22. Further, the right and left post/hinge extensions 21 and 23 serve to prevent sport spectators access or exposure to flexible wire cables providing power and signaling to the right and left gates 24 and 26. Power and signaling to the electronic display modules 16 on the front face 14 of the right and left posts 20 and 22 may be led directly upward in wire cables from the lower chase or sill 74, whereas wire cabling carrying power and signaling to the right and left gates 24 and 26 must be flexible to accommodate the motion of the right and left gates 24 and 26 relative to the right and left posts 20 and 22. A right pneumatic device 76 is partially visible (and partially shown in ghost) to urge and bias the right gate 24 to an open position/condition. The right pneumatic device 76 is pivotably attached to the right gate 24 adjacent the top right four-bar hinge 30 and pivotably attached to the right post 20. Another pneumatic device 78 is pivotably attached to left gate 26 adjacent the top left four bar hinge 42 and pivotably attached to the left post 22 and serves to urge and bias the left gate 26 to an open position/condition.

Figure 5:
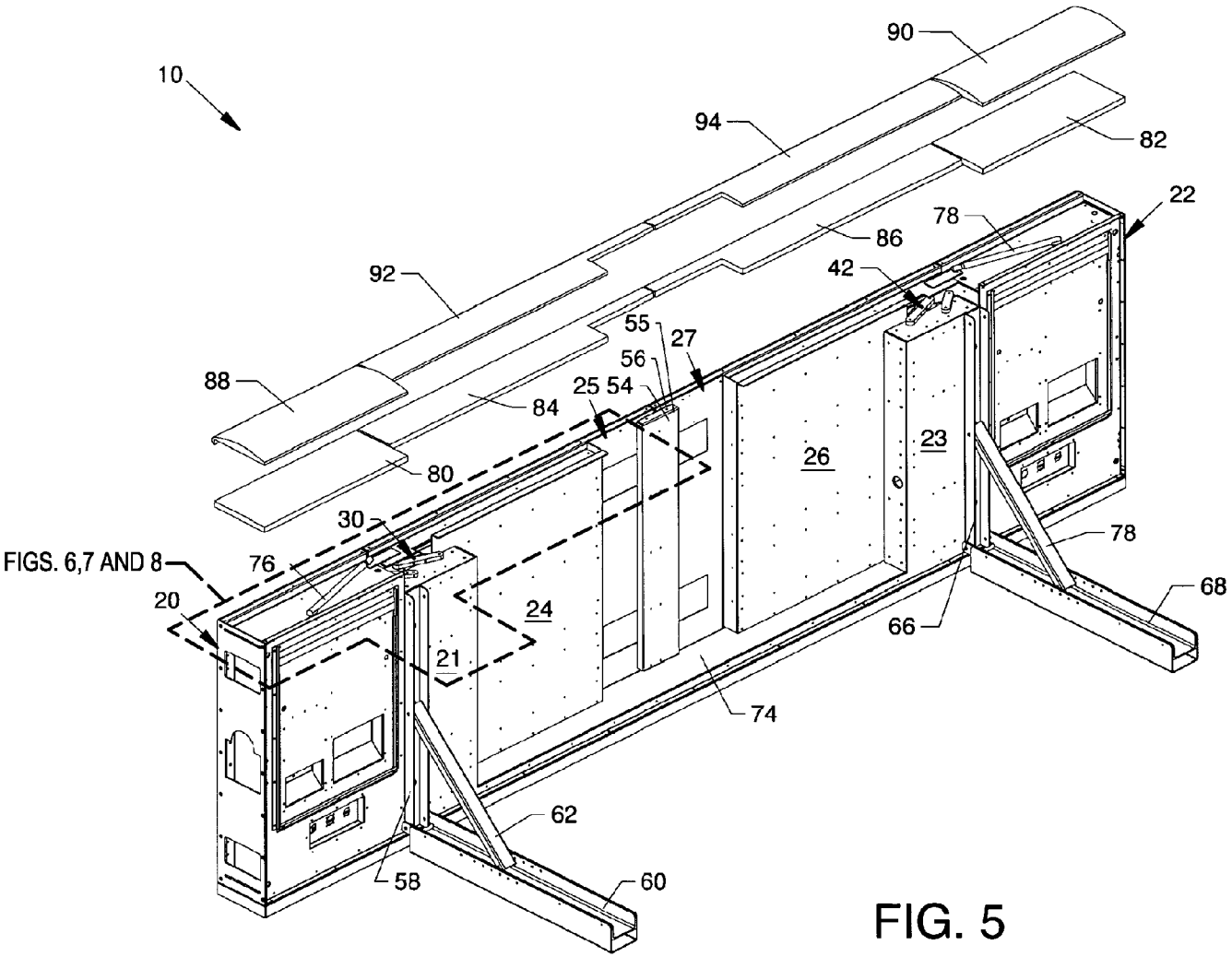
FIG. 5 is an isometric view taken from the upper rear right of the safety gate system with electronic display, previously shown in FIG. 1, shown with the gates in a closed configuration and with top structure and shields separated.

FIG. 5 is an isometric view taken from the upper rear right of the safety gate system with electronic display, previously shown in FIG. 1, shown with the gates in a closed configuration and with top structure and shields separated. In particular as shown in separated fashion, a right post top cover 80 is used to cover the top of the right post 20, a left post top cover 82 is used to cover the top of the left post 22, a right gate top cover 84 is used to cover the top of the right gate 24, and a left gate top cover 86 is used to cover the top of the left gate 26. Shields having a slight curvature to facilitate shedding rain and/or beverages, cover and protect the right post top cover 80, the left post top cover 82, the right gate top cover 84, and the left gate top cover 86, as well as structures and devices situated below the right post top cover 80, the left post top cover 82, the right gate top cover 84, and the left gate top cover 86. In particular, a right post shield 88 protects the right post top cover 80 and the right post 20 thereunder; a left post shield 90 protects the left post top cover 82 and the left post 22 thereunder; a right gate shield 92 protects the right gate top cover 84 and the right gate 24 thereunder; and a left gate shield 94 protects the left gate top cover 86 and the left gate 26 thereunder. Optionally, while major portions of the posts and gates and covers may be metal, such as light gauge steel or aluminum, the shield may be made of a weather and sun resistant plastic or of light gauge metal coated with a weather and light resistant finish.

Figure 6:
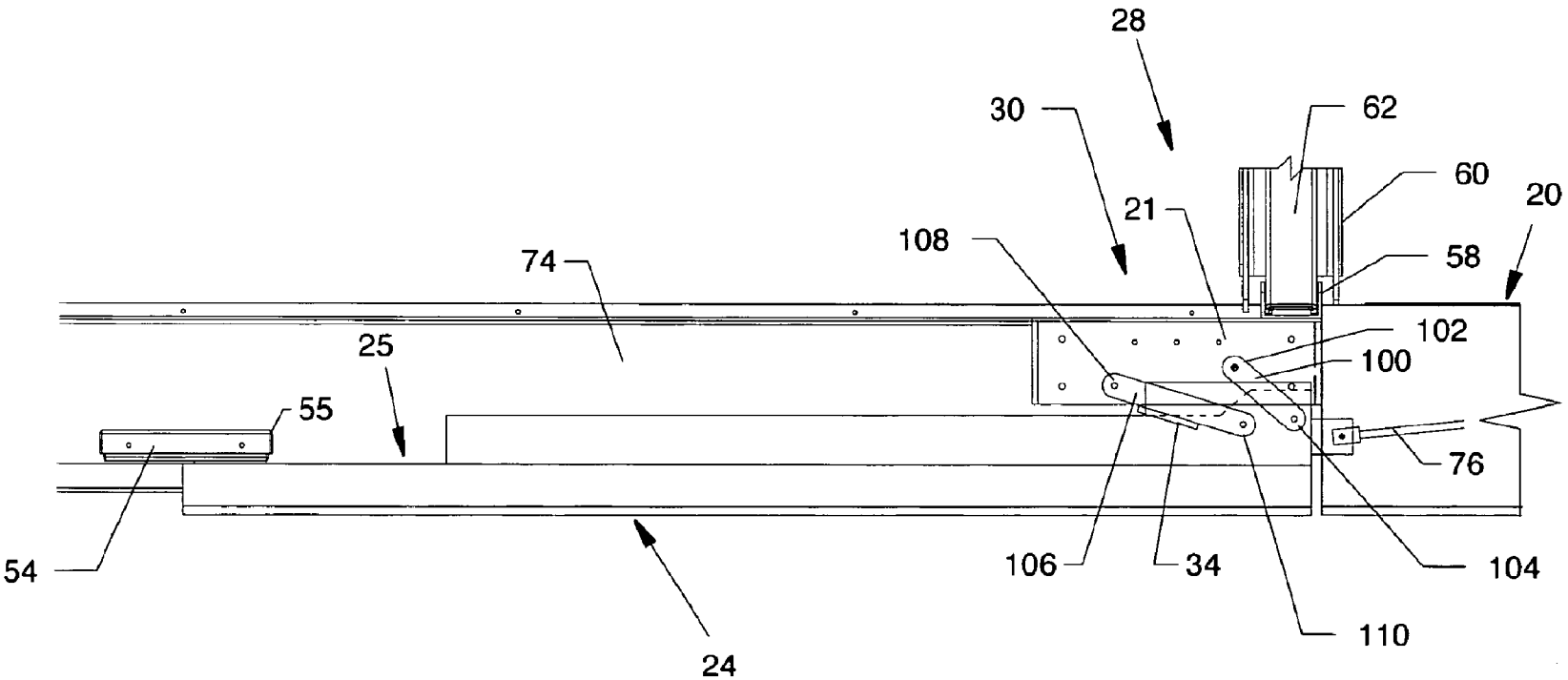
Figure 7:
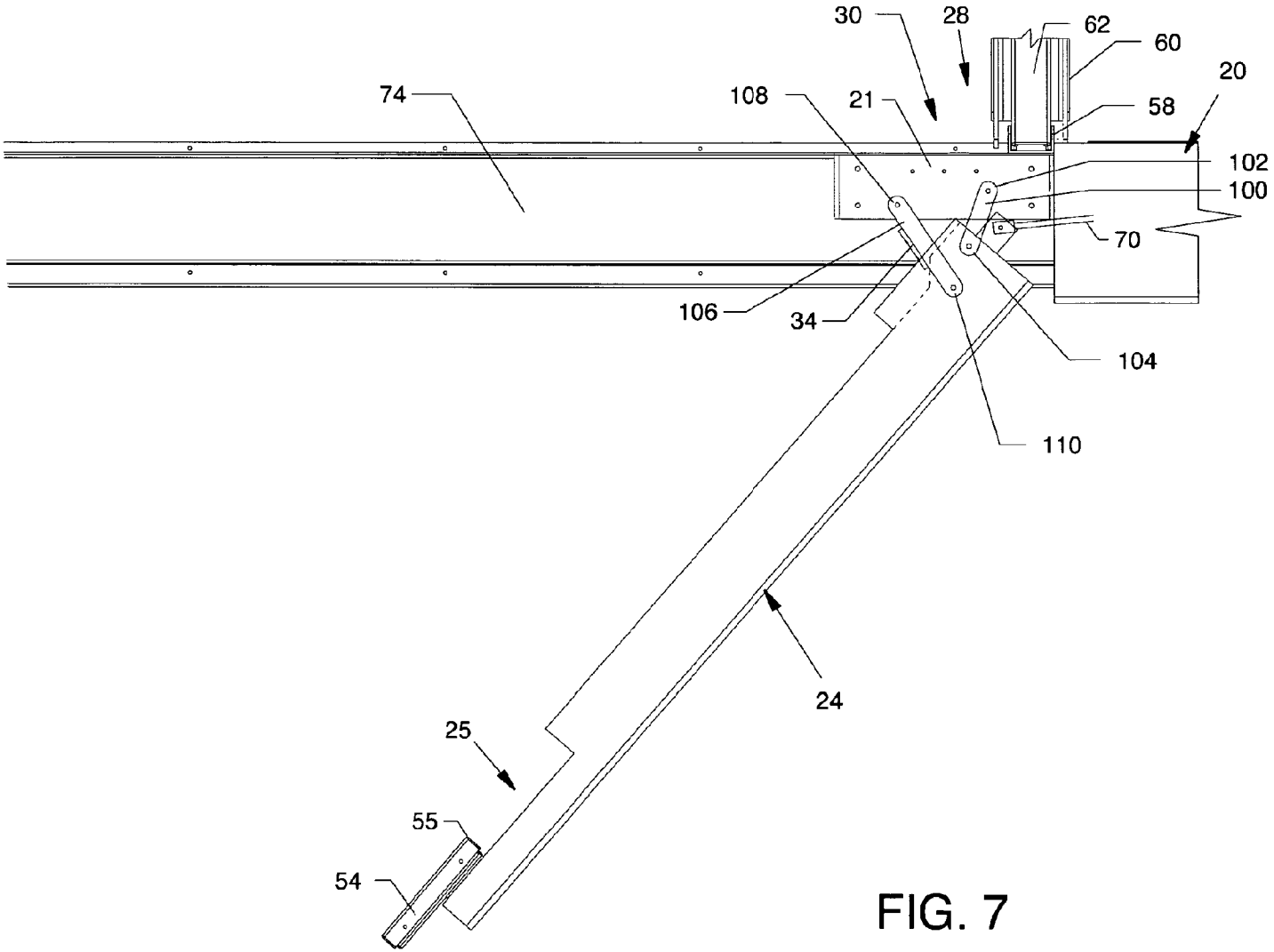
Figure 8:
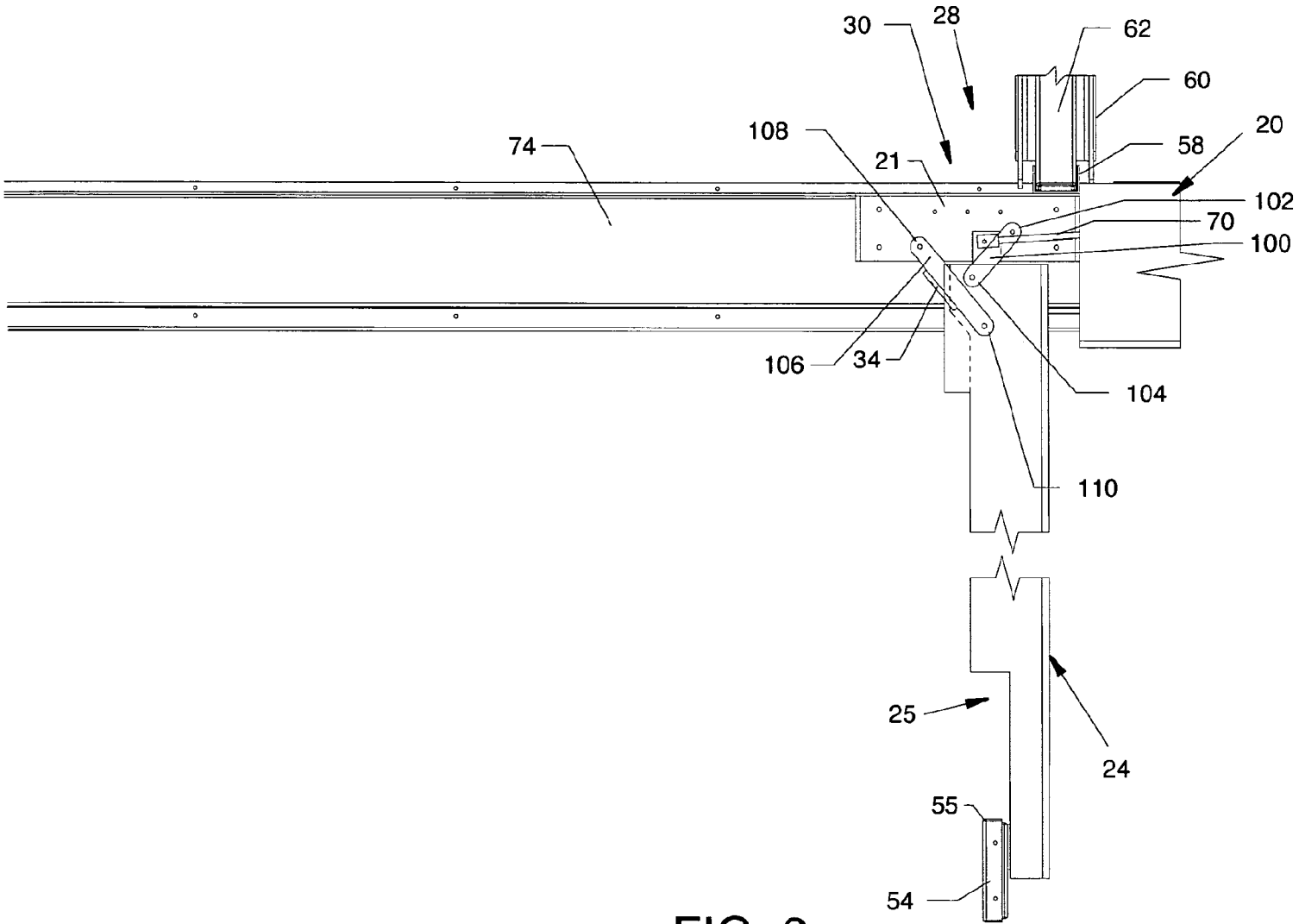

As shown in FIGS. 6, 7 and 8, the top right four-bar hinge 30 is shown, as representative, in fragmentary enlarged detail in closed, intermediate and open conditions, respectively. The remaining upper mid right four-bar hinge 32, the lower mid right four-bar hinge 36, and the bottom right four-bar hinge 38, align beneath the top right four-bar hinge 30 and operate similarly and simultaneously, and the opposing four-bar hinges operate in mirror fashion. The top right four-bar hinge 30 includes a short bar 100 having a pivotally connected frame end 102 and a pivotally connected gate end 104. The top right four-bar hinge 30 also includes the long bar 106 having a pivotally connected frame end 108 and a pivotally connected gate end 110. As previously mentioned, the long bar 106 is attached to the upper right hinge coordinator plate 34, thereby linking the top right four-bar hinge 30 to underlying upper mid right four-bar hinge 32 through the similar long bar 106 of the upper mid right four-bar hinge 32. The frame ends 102 and 108 are pivotally connected to the relevant right post/hinge extension 21 such that the short bar frame end 102 is closer to the right post 20 and the long bar frame end 108 is spaced apart from the short bar frame end 102. Thus, the right post/hinge extension 21 provides a bar of the top right four-bar hinge 30. The gate ends 104 and 110 are pivotally connected to the right gate 24, such that long bar gate end 110 is closer to the right reduced gate section 25 of the right gate 24 and the short bar gate end 104 is spaced apart from the long bar gate end 110. Thus, the right gate 24 forms a bar of the top right four-bar hinge 30. Note that in the closed condition/position, the short bar 100 and the long bar 106 are spaced apart and generally, relatively, although not truly or fully, parallel to each other. As the right gate 24 progressively opens, the short bar 100 pivots more than the long bar 106 such that at an open position/condition the short bar 100 is oriented nearly perpendicular to the long bar 106. While opening, the long bar 106 pivots roughly about 45 degrees about frame end 108, while the short bar 100 pivots roughly about 100 degrees about frame end 102. During this opening motion, the right gate 24 moves forward and slightly toward the opposing left gate 26 and away from the right post 20. The right reduced gate section 25 also moves forward toward the pitch, such that interference is avoided. The latch projection 54 serves to push the left gate 26 open slightly ahead of the right gate 24 by acting upon the left reduced gate section 27 of the left gate 26. The right pneumatic device 76 is also shown pivotally attached urging and biasing the right gate 24 from closed position/condition of FIG. 6 through the intermediate position/condition of FIG. 7 and toward the open condition/position shown in FIG. 8.

Figure 9:
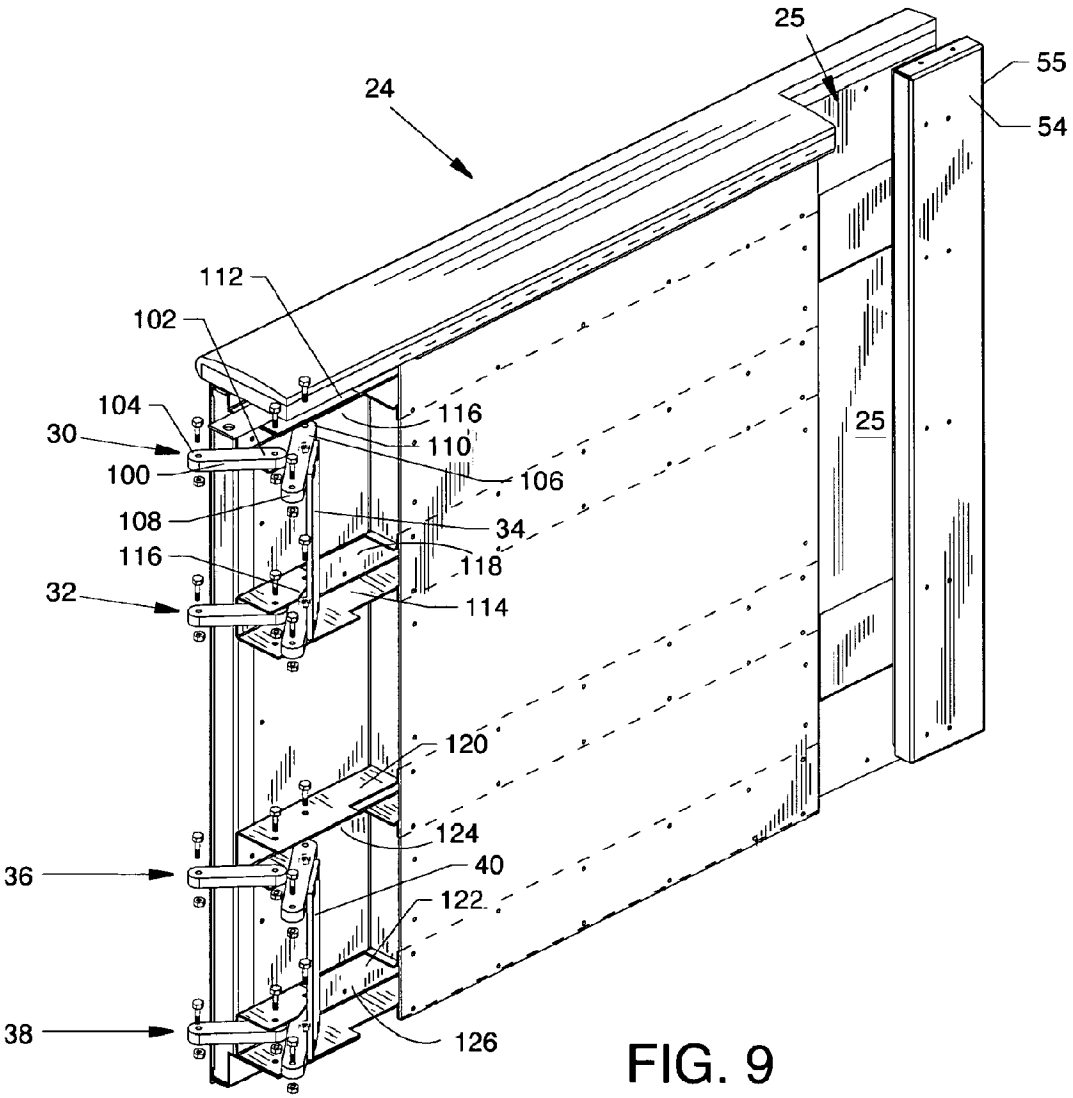

As shown in FIG. 9, a view of the right gate 24 with an exploded view of the top right four-bar hinge 30 in the open condition/position and slightly vertically foreshortened is shown for purposes of demonstration and clarity to best show and reveal the long bar gate end 110 and the short bar gate end 104. The long bar gate end 110 and the short bar gate end 104 are both pivotally connected to a rib 112 of the right gate 24. The rib 112 is a three sided horizontally oriented member near the top of the right gate 24. The rearward portion of the rib 112 is open and the short bar gate end 104 and the long bar gate end 110 are pivotable connected to the bottom side of the rib 112, preferably by shoulder bolts. The rib 112 is notched on the bottom side to accommodate and allow the upper right hinge coordinator plate 34 to rotate with the long bar 106 while pivoting at the long bar gate end 110. The upper mid right four-bar hinge 32 also has a long bar similar to long bar 106 connected to the upper right hinge coordinator plate 34 and at a long bar gate end is pivotally connected to an upper mid rib 114 of the right gate 24. The upper mid rib 114 is also a horizontally oriented three sided member with the rearward portion open. In mirror fashion to the lower side of the rib 112, the upper side of the rib 114 is notched so as to accommodate and allow the upper right hinge coordinator plate 34 to rotate with the long bar of the upper mid right four-bar hinge 32. The long bar gate end and the short bar gate end of the upper mid right four-bar hinge 32 are connected to the upper side of the rib 114, preferably by shoulder bolts. In similar fashion, a lower mid rib 120 and a bottom rib 122 are pivotally connected to gate ends of long bars of the lower mid right four-bar hinge 36 and the bottom right four-bar hinge 38, respectively. The ribs 120 and 122 are each three-sided horizontally oriented members, open on their rearward portions. The rib 120 has a notch 124 on the bottom side to accommodate and allow the lower right hinge coordinator plate 40 to rotate with the long bar of the lower mid right four-bar hinge 36 and the rib 122 has a notch 126 on the upper side to accommodate and allow the lower right hinge coordinator plate 40 to rotate with the long bar of the bottom right four-bar hinge 38. As mentioned earlier, the lower right hinge coordinator plate 40 connects the long bars of the lower mid right four-bar hinge 36 and the bottom right four-bar hinge 38. The short bars of the lower mid right four-bar hinge 36 and the bottom right four-bar hinge 38 are also pivotally connected and moved as the short bar 100 of the representative top right four-bar hinge 30, as depicted in FIGS. 6, 7 and 8. Correspondingly, the left gate 26 has mirror image notched ribs and the top left four-bar hinge 42, and also includes the upper mid left four-bar hinge, the lower mid left four-bar hinge, and the bottom left four-bar hinge (not shown). The notched ribs in the left gate 26 accommodate and allow rotation of the upper left hinge coordinator plate 46 and lower left hinge coordinator plate in mirror image fashion to that described and shown for the right gate 24. Preferably, the ribs 112, 114, 120 and 122 are reversible to reduce the number of parts maintained for manufacture of the right gate 24. By appropriate manipulation, the ribs 112, 114, 120 and 120 may be oriented to accept the shoulder bolts and short and the long and short bars 100 and 106. Also, the rib placement contributes to supporting the three horizontal rows of electronic display modules 16. As shown in FIG. 9, in ghost, the ribs 112, 114, 120 and 122 are suitably secured to panels, for example, by screws, rivets, or spot welds, preferably to flanges on the ribs 112, 114, 120 and 122, to contribute to grid structure.

MODE OF OPERATION

Operation of the safety gate system 10 of the present invention involves providing a safety gate system 10 installed in the barrier 12 and providing power and signaling for controlling displays of electronic display modules 16 carried on the front face 14. This power and signaling may be connected to either the right post 20 or the left post 22, preferably at or adjacent to the lower chase or sill 74, and also such power and signaling may be passed through the lower chase or sill 74 and thence along to the opposite post, either left post 22 or right post 20, to continue power and control to remaining portions of the barrier 12. Employing software controls, such as, for example, those generated by a Venus® Controller and/or a V-Link® controller, both available from Daktronics, Inc. of Brookings, S.D., various graphics and/or messages may be displayed in an apparently seamlessly integrated fashion upon the safety gate system 10 and the barrier 12 due to matching of the spacing and alignment of the grid arrays or matrices of rows and columns therebetween. A circuit is also provided for controlling an electromagnet, if present, in the latch projection 54. (Alternatively, the electromagnet might be substituted for the magnetic mating latch 56. In such an alternative, the latch projection could include a steel plate.) The safety gate system 10 then may be employed to separate fans or attendees from a pitch, field, or stage. Under normal operating conditions during a sporting event or performance, the electromagnet circuit of the latch projection 54 or alternatively the magnetic mating latch 56 is activated, if present. At either the conclusion of the event or during a recognized dangerous crowd condition, the electromagnetic circuit for the latch projection 54 and the magnetic mating latch 56 may be deactivated, thereby releasing the right and left gates 24 and 26, and assisted by biasing and urging from the right and left pneumatic devices 76 and 78, the right and left gates 24 and 26 are moved from a closed position/condition to an open condition/position. This allows the crowd to access the pitch, field or stage and reduces the crowd density. The electromagnetic circuit for latching may be arranged to open all such controlled safety gates present at the event or only individually selected safety gate systems 10 associated with crowd trouble spots. If, however, a dangerous crowd condition or incursion develops either too rapidly or remains unnoticed, crowd pressure applied to the right and left gates 24 and 26 will cause the latch projection 54 to separate from the magnetic mating latch 56 so as to yield automatically and without need for remote intervention. This, in turn, causes the right and left gates 24 and 26 to move to the open condition/position and allows relief from the dangerous crowd pressure. Subsequently, the right and left gates 24 and 26 may be reset to a closed condition/position by re-energizing the electromagnetic circuit, if present, and then applying sufficient closing force to overcome the right and left pneumatic devices 76 and 78. Note that the right gate 24 needs to be closed first and the left gate 26 closed second to accommodate the latch projection 54 carried on the rear face of the right gate 24.

Various modifications can be made to the present invention without departing from the apparent scope thereof.

PARTS LIST

10 safety gate system
12 barrier
14 front face
16 electronic display module
18 louver panel
20 right post
21 right post/hinge extension
22 left post
23 left post/hinge extension
24 right gate
25 right reduced gate section
26 left gate
27 left reduced gate section
28 rear face
30 top right four-bar hinge
32 upper mid right four-bar hinge
34 upper right hinge coordinator plate
36 lower mid right four-bar hinge
38 bottom right four-bar hinge
40 lower right hinge coordinator plate
42 top left four-bar hinge
44 upper mid left four-bar hinge
46 upper left hinge coordinator plate
48 lower mid left four-bar hinge
50 bottom left four-bar hinge
52 lower left hinge coordinator plate
54 latch projection
55 beveled corners
56 magnetic mating latch
58 right rear vertical channel
60 right rear leg
62 right brace
64 pin
66 left rear vertical channel
68 left rear leg
70 left brace
72 pin
74 lower chase or sill
76 right pneumatic device
78 left pneumatic device
80 right post top cover
82 left post top cover
84 right gate top cover
86 left gate top cover
88 right post shield
90 left post shield
92 right gate shield
94 left gate shield
100 short bar
102 frame end pivot of short bar
104 gate end pivot of short bar
106 long bar
108 frame end pivot of long bar
110 gate end pivot of long bar
112 rib
114 rib
120 rib
122 rib
124 notch
126 notch It is claimed:

1. A safety gate system for integration into a barrier system with electronic display capabilities so as to allow controlled passage through the barrier system, the system comprising:

a post including a post hinge extension;

a gate having a first end rotatably connected to the post hinge extension with a hinge, and movable between a closed position disallowing passage through the barrier system and an open position allowing passage through the barrier system, wherein the hinge is configured such that a back surface of the gate covers the post hinge extension when the gate is in the closed position with a front surface of the gate flush with an exposed front surface of the post, and the first end of the gate faces the post hinge extension when the gate is in an open state; and a latch system, the latch system holding the gate in the closed position, wherein the gate has a face providing an electronic display, which electronic display appears substantially seamlessly integrated into the electronic display capabilities of the barrier system.

2. The safety gate system of claim 1, including the electronic display capabilities of the barrier system and the electronic display of the face of the gate both employ electronic display modules mounted in a grid arrangement, of an array of rows and columns, conveying an impression of seamless integration into the electronic display capabilities of the barrier system.

3. The safety gate system of claim 1, wherein the gate is one of a pair of gates, the pair of gates oriented substantially co-aligned in a mutually closed position and oriented substantially parallel and spaced apart in a mutually open position.

4. The safety gate system of claim 3, wherein the latch system holds the pair of gates in the mutually closed position.

5. The safety gate system of claim 1, wherein the latch system includes a magnetic latch.

6. The safety gate of claim 5, wherein the magnetic latch includes an electromagnet and the electromagnet may be remotely released to allow the gate to move toward the open position when released from the closed position.

7. The safety gate system of claim 1, wherein the latch system auto-releases when subjected to sufficient opening force.

8. The safety gate system of claim 7, wherein the force sufficient to auto-release the latch system is from about 1 kg to about 30 kg.

9. The safety gate system of claim 7, wherein the force sufficient to auto-release the latch system is about 20 kg of force.

10. The safety gate system of claim 1, further including biasing means to urge the gate from the closed position toward the open position.

11. The safety gate system of claim 10, wherein the biasing means is a pneumatic device.

12. The safety gate system of claim 11, wherein the pneumatic device is pivotally attached to the gate and pivotally attached to the post.

13. The safety gate system of claim 1, wherein the gate is hinged to the post with a four-bar hinge.

14. The safety gate system of claim 13, wherein the four-bar hinge is one of four four-bar hinges, the four four-bar hinges being parallel and spaced apart from each other, with two upper four-bar hinges paired together by a hinge coordinator plate and two lower four-bar hinges paired together by a hinge coordinator plate.

15. The safety gate system of claim 1, wherein the post hinge extension extends from a side end of the post and is thinner than a main portion of the post.

16. The safety gate system of claim 15, wherein the hinge includes a four-bar hinge coupled between the post hinge extension and the first end of the gate and the open position of the gate is about perpendicular to the closed position of the gate.

17. The safety gate system of claim 1, further comprising a second post.

18. The safety gate system of claim 1, further comprising a lower communications chase or sill.

19. The safety gate system of claim 18, wherein the gate swings forward.

20. The safety gate system of claim 1, wherein the post has a face including display modules and which display modules are arranged for seamless integration with the gate face and the electronic display of the barrier.

21. A safety gate system having an electronic display comprising:

a first post, the first post including a hinge extension;

a second post spaced apart from the first post, the second post having a hinge extension;

a first gate, the first gate pivotally/hingedly carried by at least one four-bar hinge between the first gate and the hinge extension of the first post, wherein the at least one four-bar hinge is configured such that a back surface of the first gate covers the hinge extension when the first gate is in a closed position with a front surface of the first gate flush with an exposed front surface of the first post, and a hinged end surface of the first gate faces the hinge extension when the first gate is in an open state;

a second gate, the second gate pivotally/hingedly carried by at least one four-bar hinge between the second gate and the hinge extension of the second post, wherein the at least one four-bar hinge is configured such that a back surface of the second gate covers the hinge extension when the second gate is in a closed position with a front surface of the second gate flush with an exposed front surface of the second post, and a hinged end surface of the second gate faces the hinge extension when the second gate is in an open state;

a magnetic latch between the first gate and the second gate, the magnetic latch holding the first and second gates in a mutually closed condition/position and yielding to a sufficient force to release the gates to an open condition, wherein the first post, the second post, and the first gate and the second gate, when in mutually closed condition between the first and second posts, together present a front face having a grid of rows and columns for accepting electronic display modules; and a plurality of electronic display modules populating the grid and connected to a power and signaling source, such that an electronic display may be presented on the front face.

22. The safety gate system of claim 21, further including a sill or chase extending between the first post and the second post, and beneath the first and second gates in the mutually closed condition/position, the sill or chase providing a passageway for power and/or signaling cabling.

23. The safety gate system of claim 21, wherein the electronic display modules of the front face of the first gate and the second gate are substantially seamlessly integrated into a barrier having a front face comprising a plurality of electronic display modules.

* * * * *